US008651322B2

(12) United States Patent
Fung

(10) Patent No.: US 8,651,322 B2
(45) Date of Patent: Feb. 18, 2014

(54) ARTICLE DISPENSING APPARATUS

(75) Inventor: Candona Y. S. Fung, Hong Kong (HK)

(73) Assignee: Sweet N Fun, Ltd., Hong Kong (HK)

( * ) Notice: Subject to any disclaimer, the term of this patent is extended or adjusted under 35 U.S.C. 154(b) by 258 days.

(21) Appl. No.: 13/136,593

(22) Filed: Aug. 3, 2011

(65) Prior Publication Data

US 2013/0032607 A1 Feb. 7, 2013

(51) Int. Cl.

*G07F 11/00* (2006.01)
*A24F 15/04* (2006.01)
*A63H 13/16* (2006.01)

(52) U.S. Cl.

USPC ..... 221/24; 221/254; 221/210; 221/217; 221/165; 221/166; 221/220; 221/202; 221/256; 221/266; 221/255; 221/263; 221/232; 221/234; 446/310

(58) Field of Classification Search

CPC ..... G07F 11/00; A24F 15/04; A63H 13/16
USPC ..... 221/254, 24, 210, 217, 165, 166, 220, 221/202, 256, 266, 255, 263, 232, 234; 446/310

See application file for complete search history.

(56) References Cited

U.S. PATENT DOCUMENTS

| | | | | | |
|---|---|---|---|---|---|
| 790,111 | A * | 5/1905 | Crossley | 221/3 |
| 1,089,229 | A * | 3/1914 | Klein | 446/310 |
| 1,291,231 | A * | 1/1919 | Stokkan | 221/17 |
| 1,725,965 | A * | 8/1929 | Ormiston | 221/24 |
| 1,887,389 | A * | 11/1932 | Adams | 221/225 |
| 2,117,370 | A * | 5/1938 | Sigg | 221/188 |
| 3,538,620 | A * | 11/1970 | Kohner et al. | 434/258 |
| 4,323,238 | A * | 4/1982 | Jernstrom et al. | 273/450 |
| 4,327,843 | A * | 5/1982 | Corley | 221/210 |
| 4,453,340 | A * | 6/1984 | Kozuka et al. | 446/437 |
| 4,798,555 | A * | 1/1989 | Schaub et al. | 446/310 |
| 4,958,746 | A * | 9/1990 | Wu | 221/24 |
| 4,998,644 | A * | 3/1991 | Pan | 221/24 |
| 5,069,650 | A * | 12/1991 | Lehmann et al. | 446/476 |
| 5,651,475 | A * | 7/1997 | Fenton | 221/24 |
| 5,673,813 | A * | 10/1997 | Russell | 221/203 |
| 6,299,015 | B1 * | 10/2001 | Hasan et al. | 221/24 |
| 6,425,495 | B1 * | 7/2002 | Senda et al. | 221/24 |
| 6,499,625 | B1 * | 12/2002 | Mendillo et al. | 221/24 |
| 6,543,639 | B1 * | 4/2003 | Kovens | 221/24 |
| 6,592,426 | B2 * | 7/2003 | Mesch | 446/310 |
| 6,634,520 | B2 * | 10/2003 | Coleman et al. | 221/24 |
| 6,681,954 | B2 * | 1/2004 | Coleman et al. | 221/254 |
| 6,857,427 | B2 * | 2/2005 | Ziegler et al. | 128/200.23 |
| 7,156,256 | B2 * | 1/2007 | Senda et al. | 221/172 |
| 7,213,723 | B2 * | 5/2007 | Schwarzli | 221/254 |

* cited by examiner

*Primary Examiner* — Gene O. Crawford
*Assistant Examiner* — Rakesh Kumar
(74) *Attorney, Agent, or Firm* — Raymond Sun

(57) ABSTRACT

An article dispensing apparatus has a housing defining a first chamber and a second chamber that are divided by a dividing wall, a lid covering the second chamber and a cover covering the first chamber, with the first chamber holding a plurality of articles, and an opening provided in the dividing wall to allow an article to pass through to the second chamber. A figure is retained inside the second chamber, the figure having a pair of arms that are normally positioned adjacent the opening in the dividing wall to receive an article that is transferred from the first chamber via the opening in the dividing wall. An actuator is coupled to the figure to push the figure upwardly through the lid so that the figure, and the article held in the arms of the figure, are delivered outside the housing.

10 Claims, 7 Drawing Sheets

15
47
181
45
46
18
46
46
182
183
271
272
27

ARTICLE DISPENSING APPARATUS

BACKGROUND OF THE INVENTION

1. Field of the Invention

The present invention relates to article dispensing machines, and in particular, to a candy or gumball machine that delivers a candy or gumball via a figure that pops out of a container or box.

2. Description of the Prior Art

Gumball machines have been popular novelty items for a long time. Children and adults alike have enjoyed dispensing a gumball from a traditional spherical transparent container. However, there is a need to provide increased amusement and fun through different ways of dispensing candy or gumball.

SUMMARY OF THE DISCLOSURE

It is an object of the present invention to provide a gumball machine that provides additional fun and novelty for the user.

In order to accomplish the objects of the present invention, the present invention provides an article dispensing apparatus having a housing defining a first chamber and a second chamber that are divided by a dividing wall, a lid covering the second chamber and a cover covering the first chamber, with the first chamber holding a plurality of articles, and an opening provided in the dividing wall to allow an article to pass through to the second chamber. A figure is retained inside the second chamber, the figure having a pair of arms that are normally positioned adjacent the opening in the dividing wall to receive an article that is transferred from the first chamber via the opening in the dividing wall. An actuator is coupled to the figure to push the figure upwardly through the lid so that the figure, and the article held in the arms of the figure, are delivered outside the housing.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Referring to FIGS. 1-4, the candy dispensing machine of the present invention has a container 21 that houses a figure F which can be pushed out of the container through an opening 38 covered by a pivoting lid 1.

Figure 1:
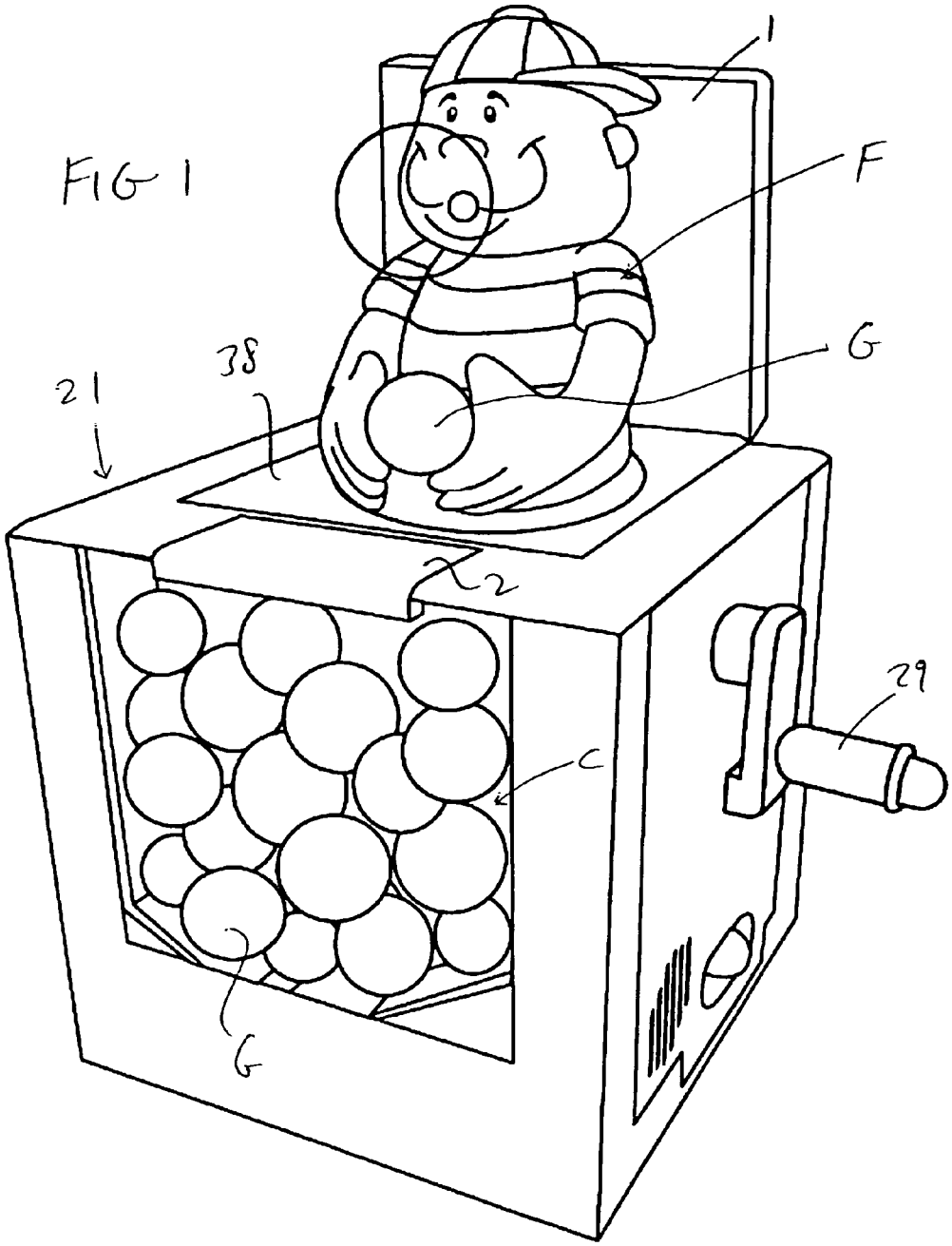
FIG. 1 is a perspective view of a candy dispensing machine according to the present invention.
Figure 2:
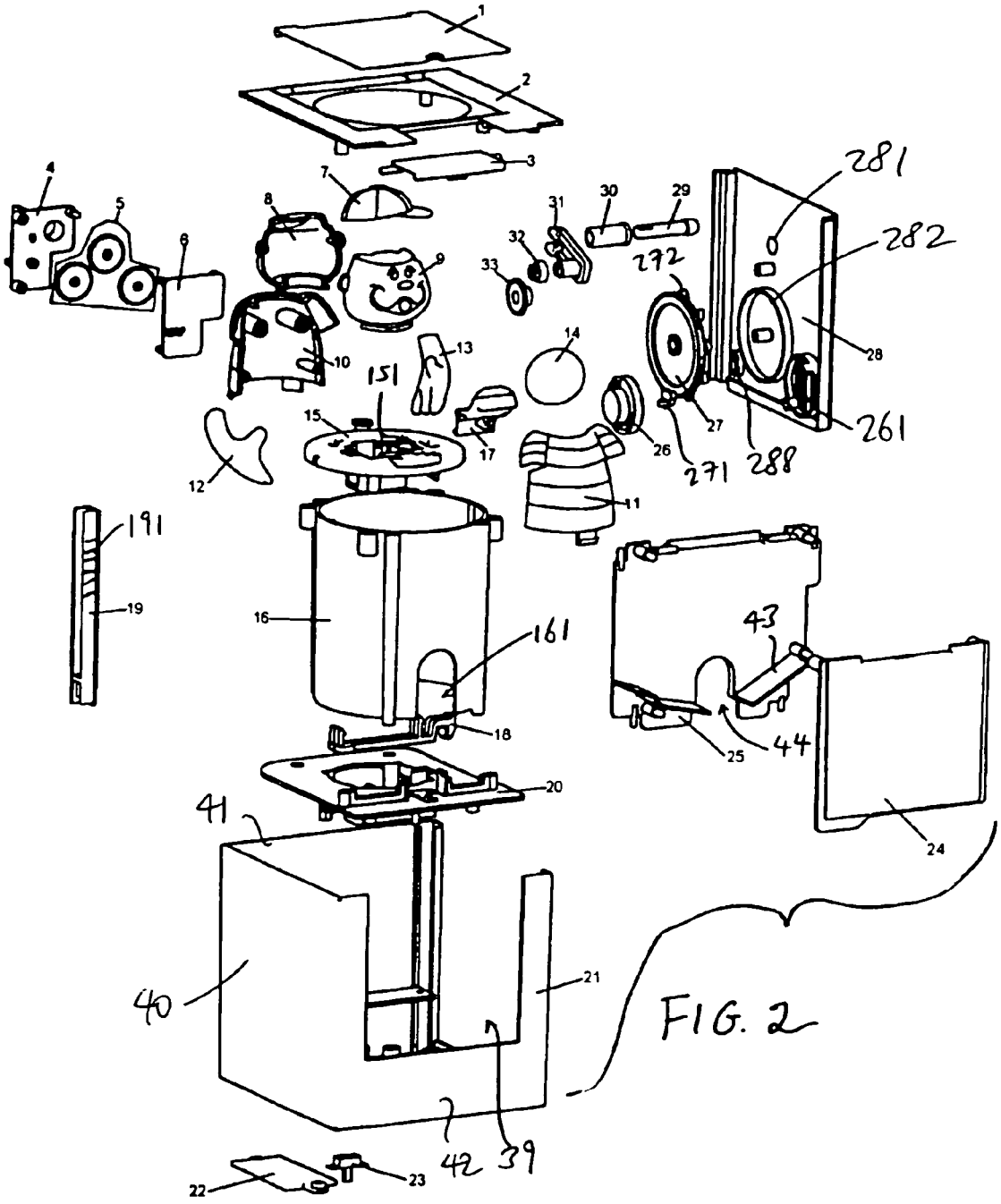
FIG. 2 is an exploded view of the machine of FIG. 1.

The container 21 has a shell (as best shown in FIG. 2) that has a base wall 45, a top wall 2, a left side wall 40, a rear wall 41, and a front wall 42, with a four-sided opening 39 provided in the front wall 42. A separate right side wall 28 can be slidably fitted between the front wall 42 and the rear wall 41. A transparent window 24 can be fitted into the opening 39. A central dividing wall 25 can be fitted inside the container 21, between the front wall 42 and the rear wall 41, such that the central wall 25 and its ramps 43 are visible to the outside via the window 24. An inverted U-shaped opening 44 is provided at the base of the dividing wall 25, with two ramps 43 attached to the dividing wall 25 and angled to direct a gumball or candy towards the inverted U-shaped opening 44. The dividing wall 25, the front wall 42 (with its window 24), and portions of the side walls 40 and 28 together define a first chamber C that holds a plurality of candy or gumballs G. The first chamber C can be accessed from the top (to add gumballs) by a pivoting cover 3 that is part of the top wall 2 of the container 21. Even though gumballs G are described in the embodiments herein, the present invention can be used to dispense other objects and articles.

Referring to FIGS. 2, 3, 4 and 7, a sliding lock 18 is retained by rails 46 on the base wall 45 for sliding motion along the base wall 45. The sliding lock 18 has a hooked end 181 at one end of a shaft 184, a catch head 183 at the opposite end of the shaft 184, and a center hook 182 extending from the shaft 184 thereof at a location adjacent the catch head 183. The catch head 183 has an angled surface 185, and defines a space 186 between the catch head 183 and the shaft 184. A spring 187 is carried on a post (not shown) extending from the rail 46, and normally biases the shaft 184 towards the direction D shown in FIG. 7.

Figure 4:
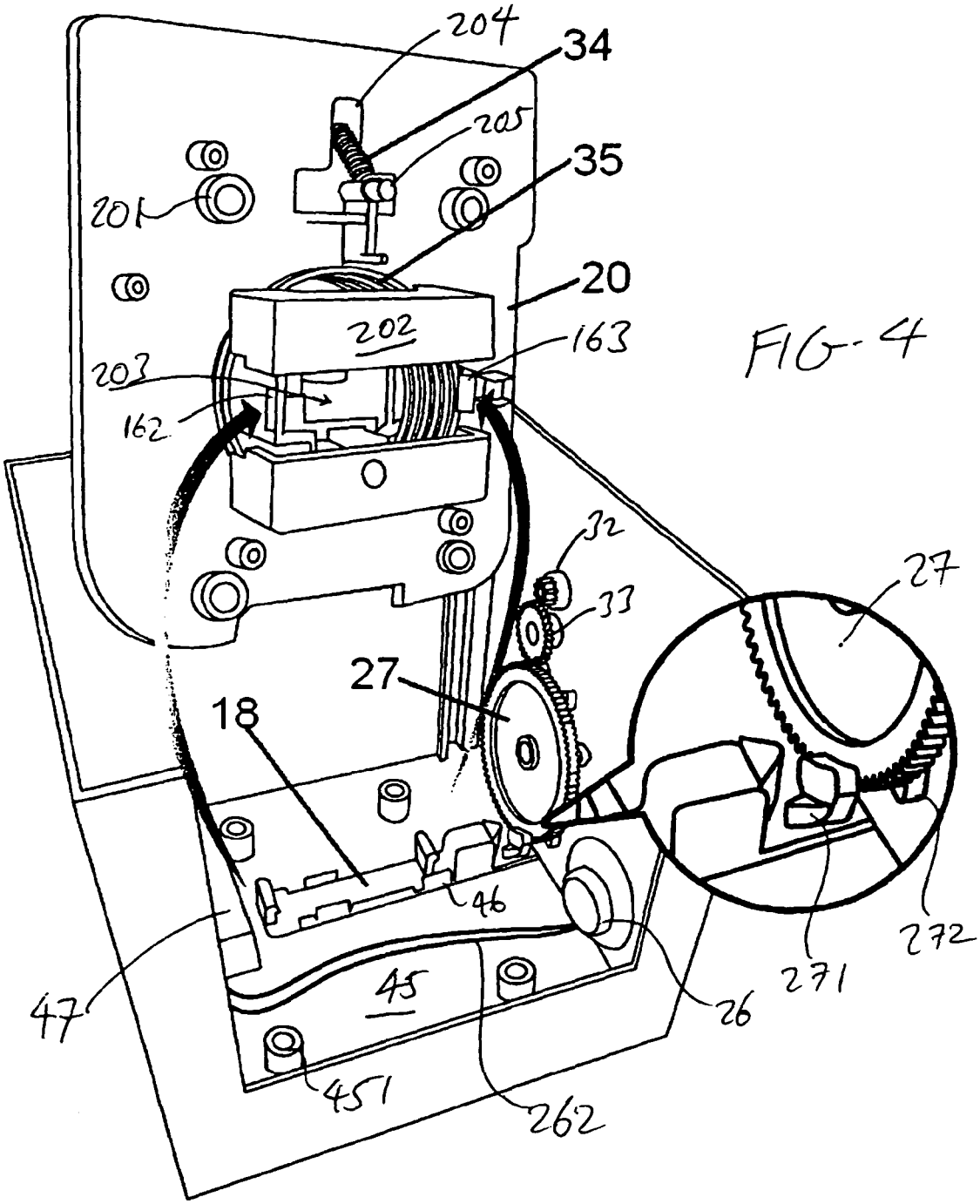
FIG. 4 is an enlarged perspective view of the components of FIG. 3 shown with the support plate turned upwards to show its bottom view.

Referring to FIG. 4, a support plate 20 is mounted on top of the base wall 45 and the sliding lock 18 via screws threaded through screw wells 201 and 451 on the support plate 20 and the base wall 45, respectively. The screw wells 201, 451 also function to space the support plate 20 from the base wall 45 to accommodate the sliding lock 18 and the figure spring 35 which are housed inside a spring housing 202 secured to the bottom of the support plate 20. The figure spring 35 extends through an opening 203 in the support plate 20.

Figure 5:
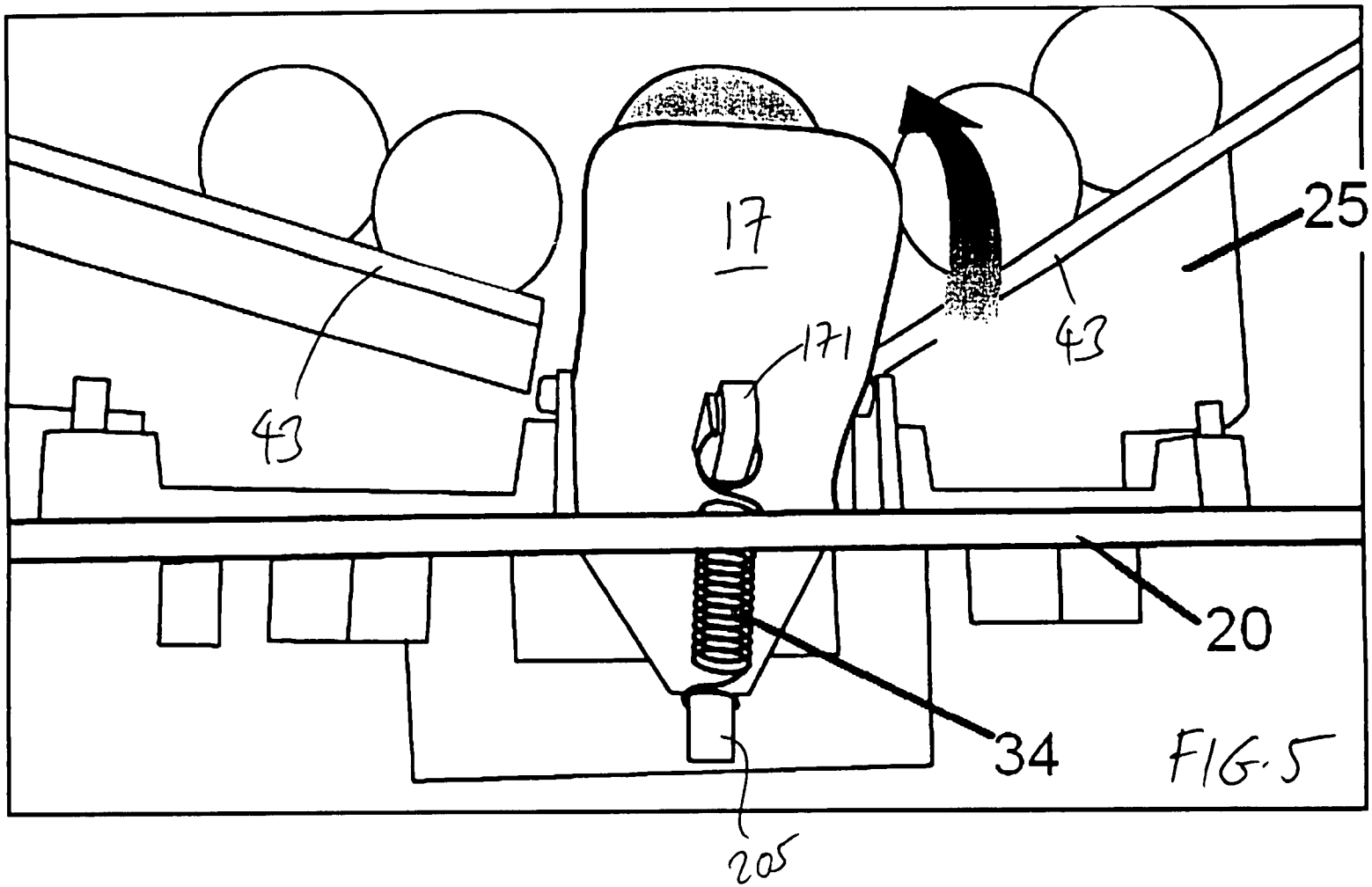
FIGS. 5 and 6 are enlarged views illustrating how a gumball is delivered to the hands of the figure.
Figure 6:
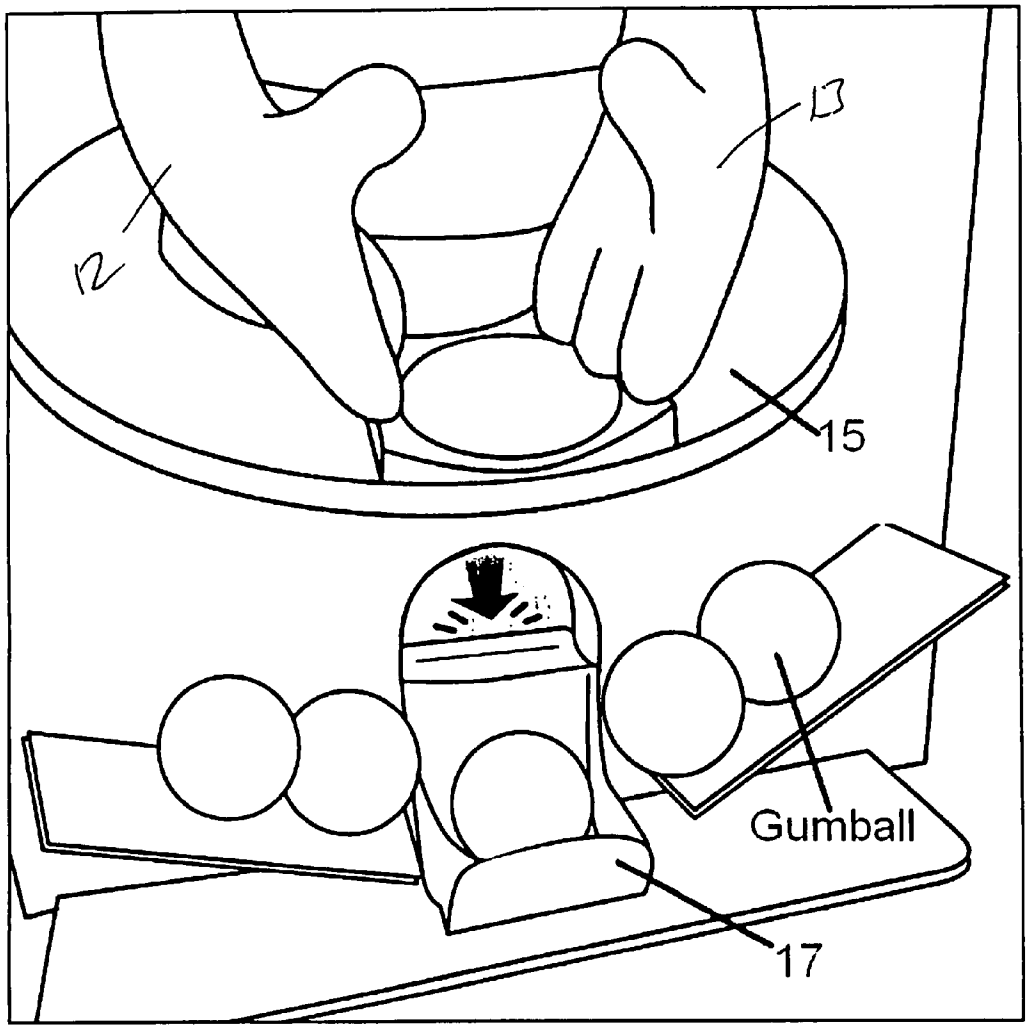
Figure 7:
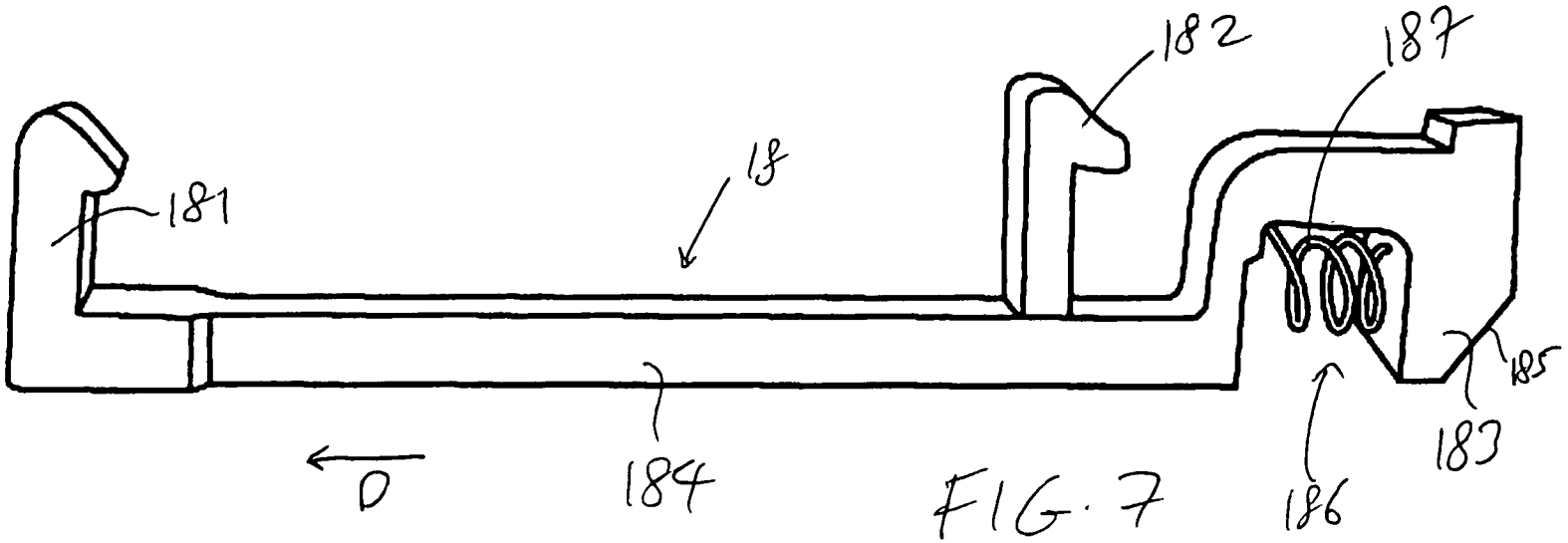
FIG. 7 illustrates the sliding lock.

Referring to FIGS. 4-6, a gumball delivery tray 17 is seated above the support plate 20 at the location of a T-shaped opening 204 on the support plate 20. A post 205 is positioned adjacent the opening 204, and a spring 34 extends from the post 205 through the opening 204 to a hook 171 on the bottom of the delivery tray 17 to normally bias the delivery tray 17 towards the opening 44 in the central wall 25. The spring 34 normally biases the delivery tray 17 towards the support plate 20 so that the delivery tray 17 can receive another gumball G from either ramp 43.

The figure F is secured to a figure holder 15 that is removably engaged to the sliding lock 18. Referring to FIG. 2, the figure F and the figure holder 15 are retained inside an enclosing wall 16 that is positioned in a second chamber defined by the rear wall 41, the dividing wall 25, and portions of the side walls 40 and 28. The figure F can be a representation of a boy, and having head portions 8, 9, body portions 10, 11, hands 12, 13, and a cap 7. However, the figure F can be the representation of any other person, animal or object. The figure holder 15 can be a circular plate that has two hooked elements 162, 163 extending from the bottom of the circular plate. These hooked elements 162, 163 are adapted to removably engage the hooked end 181 and the center hook 182, respectively, of the sliding lock 18. The enclosing wall 16 can have an opening 161 that is aligned with the opening 44 in the central wall 25, and at the location where the hands 12, 13 of the figure F are positioned when the figure F is completely housed inside the container 21 with the hooked elements 162, 163 engaging the hooked end 181 and the center hook 182, respectively.

Referring to FIG. 2, a first gear set 5 is operatively connected with a link 19. The first gear set 5 is housed in a gear housing that is made up of two separate cover elements 4 and 6. The gear housing is in turn retained inside the figure F between the body portions 10 and 11. The link 19 extends through an opening 151 in the figure holder 15, and also extends through the gears in the first gear set 5 in a manner such that movement of the link 19 up and down through the first gear set 5 will result in a clicking sound. The clicking sound is caused by notches 191 provided along the surface of the link 19 traveling through the teeth of the gears in the first gear set 5.

Figure 3:
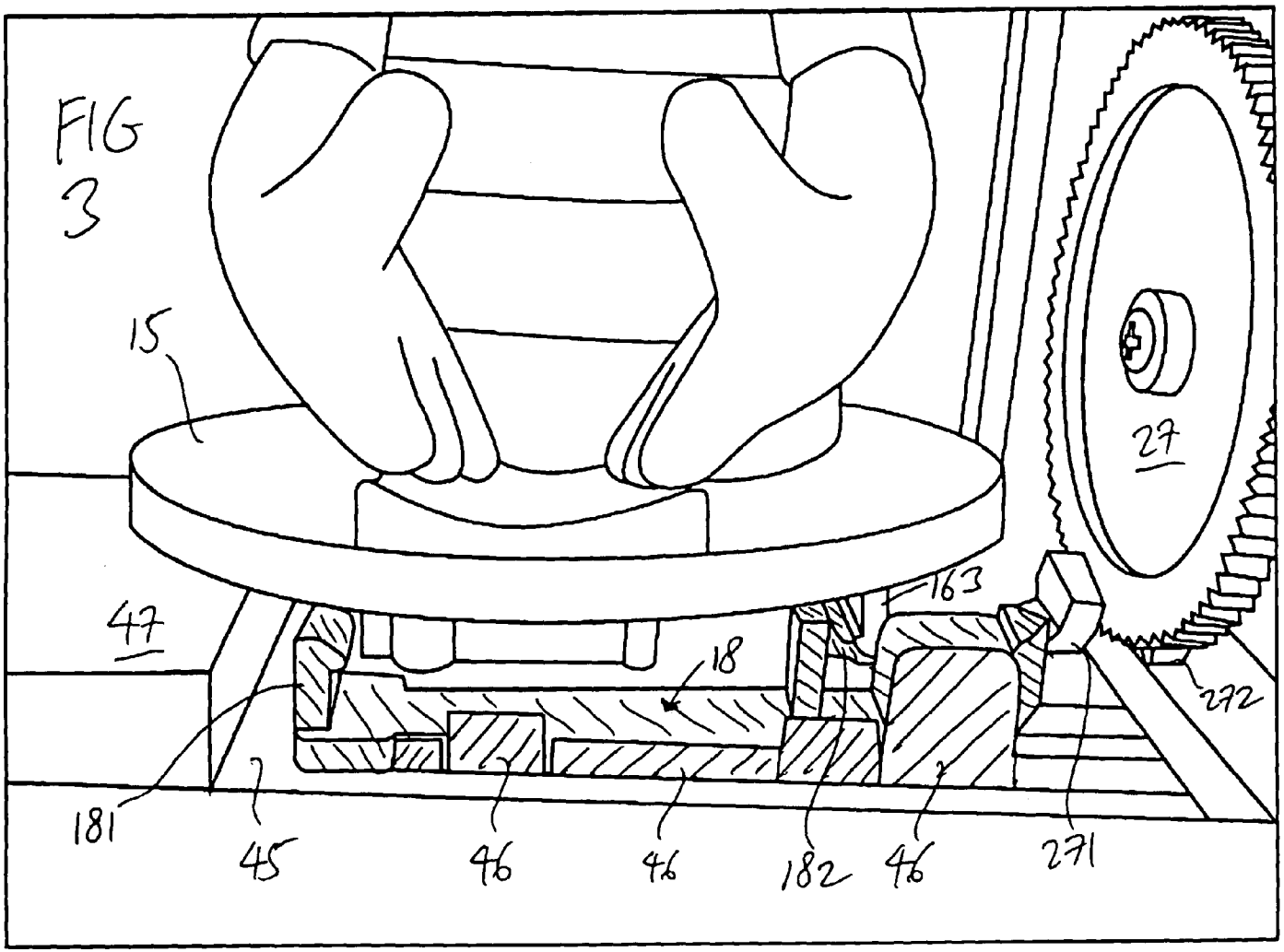
FIG. 3 is an enlarged front view of part of the interior of the machine of FIG. 1.

The right side wall 28 can be snap-fitted or otherwise secured to the edges of the rear wall 41 and the front wall 42. Referring to FIGS. 2-4, the inner surface of the right side wall 28 carries a second gear set that includes a small gear 32, a middle gear 33, and a large gear 27. A capstan handle 29 extends through an opening 281 in the right side wall 28, and has an inner end that is coupled to a connecting part 31 via a handle cover 30. The small gear 32 is carried on the connecting part 31, and its teeth operatively engage the teeth of the middle gear 33, whose teeth in turn operatively engage the large gear 27. The large gear 27 is carried for rotation by a gear housing 282 provided on the inner surface of the right side wall 28, and has a latch member 271 extending from a peripheral edge thereof. The latch member 271 is adapted to engage the angled surface 185 of the catch head 183 to pull the sliding lock 18 towards the large gear 27 against the normal bias of the spring 187. The large gear 27 also carries a plurality of bumps 272 that are spaced apart from each other in an equi-distant manner.

Referring to FIGS. 2 and 4, a speaker 26 can be retained in a speaker mount 261 provided in the inner surface of the right side wall 28. Wires 262 electrically connect the speaker 26 with a processor (not shown) which can be provided on a PCB (printed circuit board—not shown) mounted on the base wall 45 or on the inner surface of the left sidewall 40. Additional wires (not shown) electrically connect the power supply to the PCB and an on/off switch 23, and another switch 288 (described below) to the PCB and the power supply. The power supply can be embodied in the form of batteries housed in a battery compartment 47 that is provided on the base wall 45, and which also acts as a stop member for the hooked end 181 of the sliding lock 18. A battery cover 22 provides access to the battery compartment 47. An on/off switch 23 is provided along the base wall 45 or the left side wall 40 for the user to actuate the machine.

In operation, the figure F is normally housed inside the enclosing wall 16, under the lid 1, and with the hooked elements 162, 163 of the figure holder 15 engaging the hooked end 181 and the center hook 182, respectively, to keep the figure F inside the container 21 against the bias of the figure spring 35. In this position, the arms 12, 13 of the figure F will be positioned at the openings 44 and 161, so that the delivery tray 17 can deliver an article (e.g., gumball G) from the chamber C through the openings 44 and 161 to be received by the arms 12, 13. When the user turns the capstan handle 29, the connecting part 31 will rotate, causing the small gear 32 carried thereon to rotate, which in turn causes the middle gear 3 to rotate the large gear 27. As the large gear 27 rotates, the bumps 272 will contact a switch 288 that is positioned on the right side wall 28 adjacent the large gear 27. When a bump 272 contacts this switch 288, the circuit is closed and the speaker 26 is caused to broadcast sounds, words and/or music. In addition, rotation of the large gear 27 causes the latch member 271 to disengage the angled surface 185 of the catch head 183, so that the natural bias of the spring 187 will bias the shaft 184 towards the direction D shown in FIG. 7. As the sliding lock 18 moves in the direction D, the hooked end 181 and the center hook 182 will disengage the hooked elements 162 and 163 of the figure holder 15, respectively, so that the natural bias of the figure spring 35 will push the figure holder 15 upwardly, causing the figure F to push through the lid 1 to the position shown in FIG. 1 where the figure F completely exits the container 21 with a gumball G held between the arms 12, 13 of the figure F. As the figure F moves upwardly, it contacts another switch (not shown) that closes another circuit to cause music, sounds and/or words to be broadcast at the speaker 26 again.

The user can retrieve another gumball G by pushing the figure F back into the container 21, and subsequently turning the capstan handle 29 again. When the user pushes the figure F back into the container 21, the link 19 travels through the first gear set 5, and the notches 191 produce a clicking sound when the link 19 passes through the gears of the first gear set 5. The clicking sound heightens the user's senses and builds up excitement. As the figure F and the link 19 move downwardly, the bottom of the link 19 will contact the sloped top surface of the hooked end 181 of the sliding lock 18, pushing the sliding lock 18 in a direction opposite to the direction of the arrow D (against the bias of the spring 187). The figure F is completely reset when the figure F is pushed to the point where the hooked elements 162, 163 of the figure holder 15 engage the hooked end 181 and the center hook 182, respectively, against the bias of the figure spring 35. In this position, the arms 12, 13 of the figure F will again be positioned at the opening 161, so that the delivery tray 17 can deliver an article (e.g., gumball G) from the chamber C through the openings 44 and 161 to be received by the arms 12, 13.

Thus, the present invention provides a novel construction and method of delivering an article such as a gumball or candy. The article is delivered in the arms of a pop-up figure, accompanied by music, sounds and/or words.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An article dispensing apparatus, comprising:

a housing defining a first chamber and a second chamber that are divided by a dividing wall, a lid covering the second chamber and a cover covering the first chamber, the first chamber holding a plurality of articles, wherein the dividing wall has an opening;

a figure retained inside the second chamber, the figure having a pair of arms that are normally positioned adjacent the opening in the dividing wall to receive an article that is transferred from the first chamber via the opening in the dividing wall; and an actuator coupled to the figure to push the figure upwardly through the lid so that the figure, and the article held in the arms of the figure, are delivered outside the housing;

wherein the housing has a base, and further including a sliding lock positioned below the figure and adjacent the base, the sliding lock coupled to the actuator and removably engaging the figure, wherein actuation of the actuator disengages the sliding lock from the figure so that the figure is biased upwardly through the lid; and wherein the actuator includes a handle, and a gear set that is coupled to the handle, with the gear set including a gear that engages a portion of the sliding lock, wherein rotation of the gear set causes the gear to disengage the sliding lock, thereby causing the sliding lock to disengage the figure.

2. The apparatus of claim 1, wherein the article is a gumball.

3. The apparatus of claim 1, further including a speaker which emits sounds, music and/or words when the figure is pushed upwardly.

4. The apparatus of claim 1, wherein a first spring is positioned below the figure to naturally bias the figure upwardly.

5. The apparatus of claim 4, wherein a second spring naturally biases the sliding lock in a first direction.

6. The apparatus of claim 1, wherein the figure has a hooked element, and the sliding lock has a complementary hooked element that removably engages the hooked element of the figure.

7. The apparatus of claim 6, wherein a spring naturally biases the sliding lock in a first direction which removably engages the hooked elements of the figure and the sliding lock.

8. The apparatus of claim 7, further including a link that is coupled to the figure, and wherein downward movement of the figure and the link will cause the link to push the sliding lock against the bias of the spring to cause the hooked element of the sliding lock to engage the hooked element of the figure.

9. The apparatus of claim 1, further including a link that is coupled to the figure, and wherein downward movement of the figure and the link will cause the link to push the sliding lock to engage the figure.

10. A gumball dispensing apparatus, comprising:

a housing having a base and defining a first chamber and a second chamber that are divided by a dividing wall, a lid covering the second chamber and a cover covering the first chamber, the first chamber holding a plurality of gumballs, wherein the dividing wall has an opening;

a figure retained inside the second chamber, the figure having a pair of arms that are normally positioned adjacent the opening in the dividing wall to receive an gumball that is transferred from the first chamber via the opening in the dividing wall;

a link that is coupled to the figure an actuator coupled to the figure to push the figure upwardly through the lid so that the figure, and the gumball held in the arms of the figure, are delivered outside the housing;

a first spring is positioned below the figure to naturally bias the figure upwardly a sliding lock positioned below the figure and adjacent the base, the sliding lock coupled to the actuator and removably engaging the figure;

a second spring which naturally biases the sliding lock in a first direction;

wherein the figure has a hooked element, and the sliding lock has a complementary hooked element that removably engages the hooked element of the figure;

wherein downward movement of the figure and the link will cause the link to push the sliding lock against the bias of the spring to cause the hooked element of the sliding lock to engage the hooked element of the figure; and wherein the actuator includes a handle, and a gear set that is coupled to the handle, with the gear set including a gear that engages a portion of the sliding lock, wherein rotation of the gear set causes the gear to disengage the sliding lock, thereby causing the second spring to bias the sliding lock in a first direction, thereby causing the hooked elements to disengage so that the figure is biased upwardly through the lid.

* * * * *